United States Patent [19]

Hodgkinson

[11] Patent Number: 4,571,596

[45] Date of Patent: Feb. 18, 1986

[54] ANTENNA MATCHING DEVICE

[75] Inventor: Alec J. Hodgkinson, Johannesburg, South Africa

[73] Assignee: Z.S. Electroniques (Proprietary) Limited, South Africa

[21] Appl. No.: 384,112

[22] Filed: Jun. 1, 1982

[51] Int. Cl.[4] ..... H01Q 1/50

[52] U.S. Cl. ..... 343/860

[58] Field of Search ..... 343/860, 850, 858, 822, 343/745, 852, 791, 865; 333/32, 124, 131, 25

[56] References Cited

U.S. PATENT DOCUMENTS

| | | | |
|---|---|---|---|
| 1,909,937 | 5/1933 | Eckersley | 333/124 |
| 2,550,891 | 5/1951 | Wald | 333/32 |
| 2,687,513 | 8/1954 | Lindenblad | 333/32 |
| 2,788,495 | 4/1957 | Hylas et al. | 333/131 |
| 2,952,822 | 9/1960 | Stone | 333/32 |
| 4,028,704 | 6/1977 | Blass | 343/860 |
| 4,423,423 | 12/1983 | Bush | 343/822 |

FOREIGN PATENT DOCUMENTS

| | | | |
|---|---|---|---|
| 966235 | 7/1957 | Fed. Rep. of Germany | 343/860 |

*Primary Examiner*—Eli Lieberman
*Assistant Examiner*—Karl Ohralik
*Attorney, Agent, or Firm*—Sughrue, Mion, Zinn, Macpeak & Seas

[57] ABSTRACT

An antenna matching device has a ferromagnetic core with a balanced shape and composition to each side of a center tap position. Each side of the core has a first and second parallel wound coil, the free end leads of the first coils being connected together, and the center-tap lead of each first coil being connected to that of the corresponding second coil on the opposite side of the core, the free end lead of each second coil being connected to its own antenna terminal.

4 Claims, 2 Drawing Figures

ANTENNA MATCHING DEVICE

BACKGROUND TO THE INVENTION

This invention relates to an antenna matching device for connection between an antenna and a radio unit to improve their performance.

In this specification the term "radio unit" must be understood to include a radio transmitter, or a radio receiver, or both.

It is the object of this invention to provide an antenna matching device which may be connected between an antenna and a radio unit to improve their performance, and more particularly, but not exclusively, to improve the bandwidth capability of an antenna.

SUMMARY OF THE INVENTION

In accordance with this invention there is provided an antenna matching device comprising a ferromagnetic core having a balanced shape and composition to each side of a centre-tap position, each side having a first and a second parallel wound coil therearound, the coils of one side being wound in the same direction from the centre-tap position as the coils of the other side, and each coil having a centre-tap lead and the first coils being connected together, and the centre-tap lead of each first coil being connected to the centre-tap lead of the second coil on the opposite core side of that first coil, to form respective radio unit feed terminals, one of which terminals is directly connected to earth, and the free end lead of each second coil being connected to its own antenna terminal.

A further feature of the invention provides for each antenna terminal to be connected to a separate antenna lead, and for the earthed radio unit feed terminal to be taken to each antenna lead through a resistor which is approximately eight times the characteristic impedance of the actual feeder cable which is to be connected to the radio unit feed terminal.

There is further provided for the antenna terminals to comprise sockets which may receive jacks therein and for one antenna terminal to be connected to the radio unit terminal which is connected to earth, and for the other antenna terminal to be connected to a length of thin wire serving as an antenna lead, and for the resistences between the earth of the radio unit feed terminal and the antenna sockets to be removed in this embodiment.

BRIEF DESCRIPTION OF THE DRAWING

A preferred embodiment of the invention is described below by way of example only, and with reference to the accompanying drawings, in which.

DETAILED DESCRIPTION OF THE DRAWING

Figure 1:
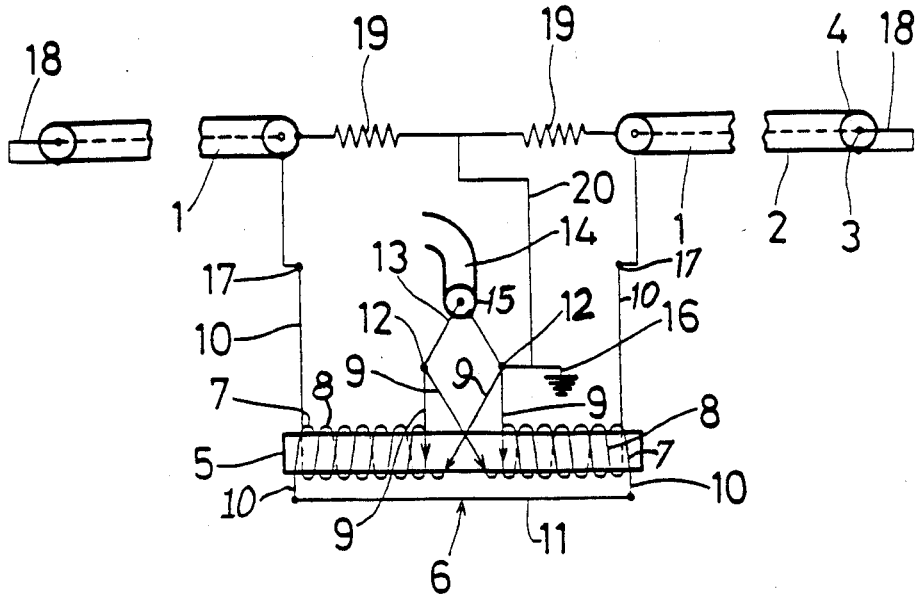
FIG. 1 is a diagramatic representation of the matching device according to the invention in use with a split horizontal antenna; and, FIG. 2 is a diagramatic representation of the device of FIG. 1 connected for use with a simple wire antenna lead.

Referring to FIG. 1, two antenna leads 1 are illustrated, each being approximately seven meters long and having a cylindrical tube 2 with a central conductor 3 with the space 4 between the central conductor and the inner walls of the tube being filled with a dielectric material.

This antenna is normally used in a whip antenna configuration, and is more particularly described in, and forms the subject matter of, applicant's South African Patent Application number 79/6143 entitled "Dielectric Antenna", filed on the Oct. 9, 1980 and claiming a priority date of Nov. 15, 1979.

The difficulty with this and other whip antennas, is that when placed in a horizontal position they are unbalanced as a result of the stray capacitance between the antenna and ground. The application of this invention, as will be described, enables the use of such an antenna in a horizontal position.

An elongated ferrite core 5 is of a balanced shape and composition to each side of a centre-tap position 6 in the middle thereof.

Each side of the core 5 has a first and second parallel wound coil, numbered 7 and 8 respectively, and the coils on each side are wound in the same direction from the centre-tap position. Each coil has a centre-tap lead 9 and a free end lead 10 at its end of the coil. The free end leads 10 of first coils 7 are connected directly together by a line shown as 11, and the centre-tap lead 9 of each first coil 7 is connected to that of the second coil 8 on the opposite side of the core respective to form radio unit feed terminals 12 at the connection points.

One of these terminals 12 is connected to the signal line 13 of a co-axial cable 14, and the other terminal 12 is connected to the earth braid 15 of the co-axial cable 14. The co-axial cable is taken as feed to the radio unit (not shown).

This other terminal 12 is also directly connected to an earth 16. The free end lead 10 of each second coil 8 is connected to a separate antenna terminal 17. Each antenna 1 at its remote end has its central wire connected to the cylindrical wall, as shown by numeral 18, and the opposite rear end of each antenna 1 has its cylindrical wall connected to a different one of the antenna terminals 17. The cylindrical walls of these rear ends of the antenna are also connected to each other through two resistances 19 which have a connection 20 between them leading to the earth 16. The resistors are preferably approximately eight times the characteristic impedance of the co-axial feed cable 14.

These resistors cause a slight damping effect ensuring the antenna is always current fed. Maximum radiation occurs from the current position of an antenna and the resistors also absorb much of the reflected energy which could cause mismatch. Therefore in the forward direction the loss is low but in the reverse the higher impedance reflected signal from a short antenna more closely matches the higher value of the resistors.

The two antennas 1 are placed horizontally relative to the ground, and it has been found in practice that the antenna matching device is extremely effective in increasing the bandwidth and effectivity of the antenna. Preferably the core 5 is in the form of a toroid with the coils wound to each side of the centre-tap position to end with their free end leads diametrically opposite this centre-tap position.

Figure 2:
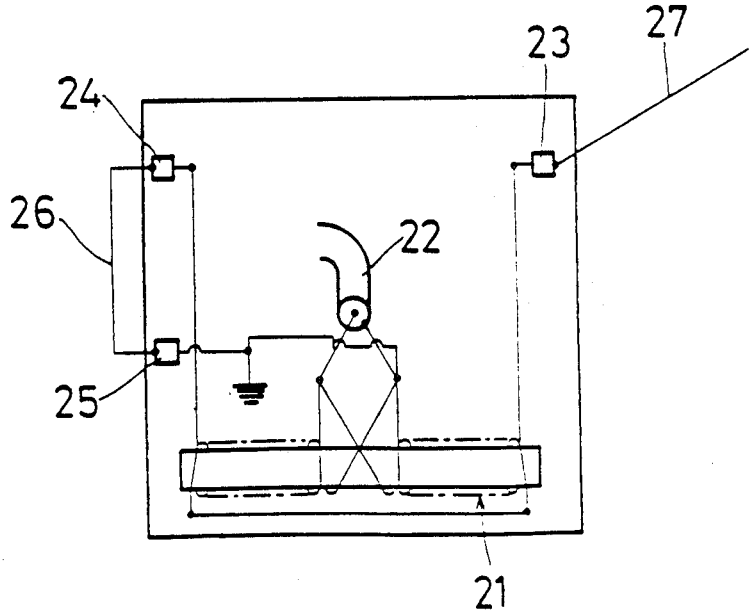

A further example of the use of the invention is illustrated in FIG. 2. The same system of coils wound on a core as described above with reference to FIG. 1, is shown generally by numeral 21, and the same co-axial feed cable 22 is shown with its leads connected to corresponding centre-tap cables as described above.

However, in this case no resistances 19 or the equivalent are provided, and the antenna terminals are connected to sockets 23 and 24. The earth position of the coils is also connected to a socket 25 and one antenna terminal socket 24 is connected to the earth socket 25 by linkage 26.

The remaining antenna terminal socket 23 has a length of thin wire 27 serving as an antenna plugged therein.

This type of wire antenna is often used in remote areas, and usually is thrown over a tree or the like before using the radio unit. The length of such a wire antenna normally varies between seven and fifty meters.

The usual procedure with such an antenna is to provide an antenna tuner in order to enable the operator of the radio unit to tune the antenna to a required frequency.

These antenna tuners are expensive, and cost in the region of U.S. $5000.

It has been found that the antenna matching device connected as described above with reference to FIG. 2, sufficiently increases the bandwidth of the wire antenna as to render such an antenna tuner unnecessary.

It will be appreciated that if the device connected for use with a wire antenna is made for this particular purpose, and encapsulated, it will be extremely small and probably not more than a few square centimeters.

It is considered that the invention provides a simple and effective antenna matching device which will also be cheap to produce.

Clearly variations may be made to the above embodiment without departing from the scope of the invention. As already mentioned, the core need not be a straight one but can be in the form of a toroid or in any other suitable balanced form. The windings themselves are limited only in so far as the relative directions are concerned and the number of windings and the size of the core will be dictated by the power requirements of the device.

What I claim as new and desire to secure by Letters Patent is:

1. An antenna matching device comprising a ferromagnetic core having a balanced shape and composition to each side of a centre-tap position, each side having first and second parallel wound coils therearound, the coils of one side being wound in the same direction from the centre-tape position as the coils of the other side, each coil having a centre-tap lead and a free end lead remote therefrom, the free end leads of the first coils being connected together to form a short circuit therebetween, the centre-tap lead of each first coil of each side being connected to the centre-tap lead of the second coil of the other side to form respective radio unit feed terminals, one of which terminals is directly connected to earth; a pair of separate antenna leads connected to respective antenna terminals, the free end lead of each second coil being connected to its own antenna terminal; and resistor means connecting the earthed feed terminal to each separate antenna lead.

2. A device as claimed in claim 1 further comprising a feeder cable connectable to said radio unit feed terminals, and wherein said resistor means comprises a resistor connected between each antenna lead and said earthed feed terminal, each resistor having a characteristic impedance approximately eight times the characteristic impedance of said feeder cable.

3. An antenna matching device comprising a ferromagnetic core having a balanced shape and composition to each side of a centre-tap position, each side having first and second parallel wound coils therearound, the coils of one side being wound in the same direction from the centre-tap position as the coils of the other side, each coil having a centre-tap lead and a free end lead remote therefrom, the free end leads of the first coils being connected together to form a short circuit therebetween, the centre-tap lead of each first coil of each side being connected to the centre-tap lead of the second coil of the other side to form respective radio unit feed terminals, one of which terminals is directly connected to earth; and a pair of separate antenna leads connected to respective antenna terminals, the free end lead of said second coil being connected to its own antenna terminal; and wherein the antenna terminals comprise sockets for jacks, and one antenna terminal is connected to the radio unit terminal which is connected to earth, the other antenna terminal being connected to a length of thin antenna wire.

4. A device as claimed in claim 1 or 2 in which the device is operatively connected to a split horizontal antenna.

* * * * *